United States Patent [19]

Lucci et al.

[11] Patent Number: 4,697,846

[45] Date of Patent: Oct. 6, 1987

[54] ADJUSTABLE CHAIR

[75] Inventors: Roberto Lucci; Paolo Orlandini, both of Milan, Italy

[73] Assignee: Fantoni Arredamenti S.p.A., Osoppo, Italy

[21] Appl. No.: 808,334

[22] Filed: Dec. 12, 1985

[30] Foreign Application Priority Data

May 8, 1985 [IT] Italy ..... 20614 A/85

[51] Int. Cl.[4] ..... A47C 3/00

[52] U.S. Cl. ..... 297/298; 297/343

[58] Field of Search ..... 297/298, 340, 341, 342, 297/343, 354, 443, 353

[56] References Cited

U.S. PATENT DOCUMENTS

| | | | |
|---|---|---|---|
| 1,802,608 | 4/1931 | Krause | 297/343 |
| 2,271,925 | 2/1942 | Niles | 297/343 X |
| 3,632,165 | 1/1972 | Miller | 297/343 X |
| 4,018,166 | 4/1977 | Gutridge et al. | 297/343 X |
| 4,384,742 | 5/1983 | Wisniewski | 297/353 |
| 4,452,486 | 6/1984 | Zapf et al. | 297/343 |
| 4,580,836 | 4/1986 | Verney | 297/443 X |

FOREIGN PATENT DOCUMENTS

| | | | |
|---|---|---|---|
| 2285260 | 5/1976 | France | 297/343 |
| 73061 | 1/1950 | Netherlands | 297/343 |

*Primary Examiner*—Peter A. Aschenbrenner

*Attorney, Agent, or Firm*—Bucknam and Archer

[57] ABSTRACT

An adjustable chair structure comprises a support frame of substantially L-shape conformation supported by a base in the form of an upright column supported on a set of radial feet carried on castors. The L-shape support frame has a horizontal arm for supporting a seat part of a seat body, and an upright (i.e. vertical or inclined at an acute angle to the vertical) arm which supports a seat back part of the seat body. The seat part is connected to the seat back part by means of a flexible tongue projecting from the middle of the rear edge of the seat part of the seat body, which tongue has notches by which the position of the seat back with respect to the seat part can be determined.

3 Claims, 10 Drawing Figures

ADJUSTABLE CHAIR

BACKGROUND OF THE INVENTION

There are currently available on the market various types of adjustable chairs which are particularly designed for office use. One of the most popular structures for an office chair comprises a base which supports a seat and a seat back. Both the seat and the seat back may be provided with independent means for their positional adjustment to suit individual users.

This type of chair structure has substantial disadvantages in that the use of separate mechanisms for the positioning of the seat back and for the positioning of the seat significantly increase the manufacturing costs because of the complexity of the structure. Moreover, in use, such known chair structures have disadvantages due to the fact that, by providing separate actuating mechanisms for the two different adjustments it is difficult to synchronise their positional variation in relation to the positional variation of the human body. In particular, it is not always possible to obtain adequate adaptation of the inclination of the seat back, with consequent lack of convenience and comfort for the utiliser.

OBJECTS OF THE INVENTION

A primary object of the present invention is to overcome the above noted disadvantages of the prior art.

A main object of the invention is to provide an adjustable chair structure which is adjustable in such a way that simultaneous adjustment of the position of the seat and of the seat back can be obtained.

Another object of the invention is to achieve the above object without needing the actuation of mechanisms which are difficult for the utiliser to gain access to.

A particular object of the invention is to provide a chair structure which offers the possibility of obtaining the whole of a wide range of positions with an automatic adjustment of the seat back to correspond to different selected positions of the seat.

A further object of the invention is to substantially improve the convenience of use and the comfort of an adjustable chair.

Another object of the present invention is to provide an adjustable chair structure which, because of its particular constructional characteristics is able to offer the widest guarantees of reliability, comfort and security in use.

Still another object of the present invention is to provide a chair structure which, as well as having significantly improved performance over chairs of the same general type known from the prior art, has a very much simplified structure and is such as to facilitate manufacture and assembly thereof.

SUMMARY OF THE INVENTION

The present invention relates to an adjustable chair, and particularly to an anatomic chair structure which can be adjusted to a plurality of different positions.

According to the present invention, there is provided an adjustable chair structure, characterised by the fact that it comprises a support frame carried on a base and having a substantially L-shape conformation with a horizontal arm for the support of the seat part of a seat body, and an upright arm for the support of a seat back part or the seat body, the said seat part of the seat body being slidably carried on the said horizontal arm and provided at the rear with a flexible projection for connection to the seat part of the seat body, which is slidably guided on the upright arm such that adjustment of the position of the seat part of the seat body causes a corresponding adjustment in the position of the seat back part of the seat body.

Various other features and advantages of the present invention will become more clearly apparent from a study of the following detailed description in which reference is made to the accompanying drawings given purely by way of non-limitative example.

DESCRIPTION OF THE PREFERRED EMBODIMENT

Figure 1:
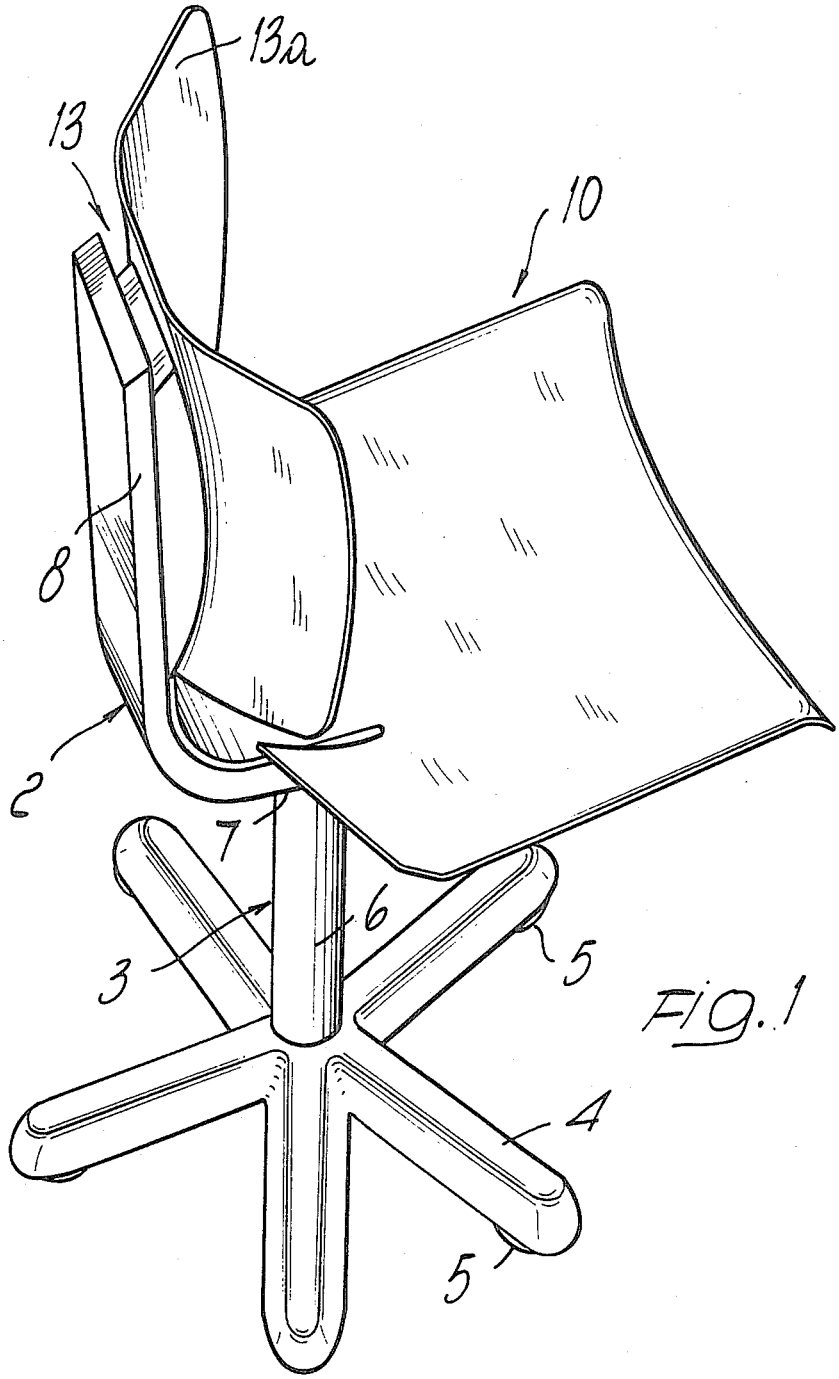
FIG. 1 is a schematic perspective view of a chair formed as an embodiment of the invention.
Figure 6:
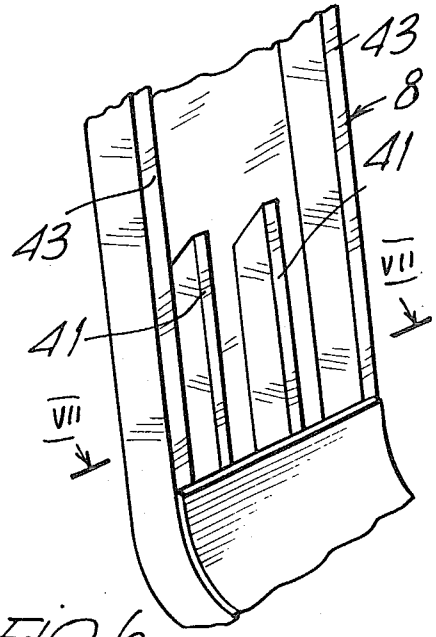
FIG. 6 is a perspective view of the vertical arm of the support frame.
Figure 7:
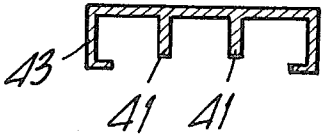
FIG. 7 is a section, taken on the line VII—VII of FIG. 6.
Figure 2:
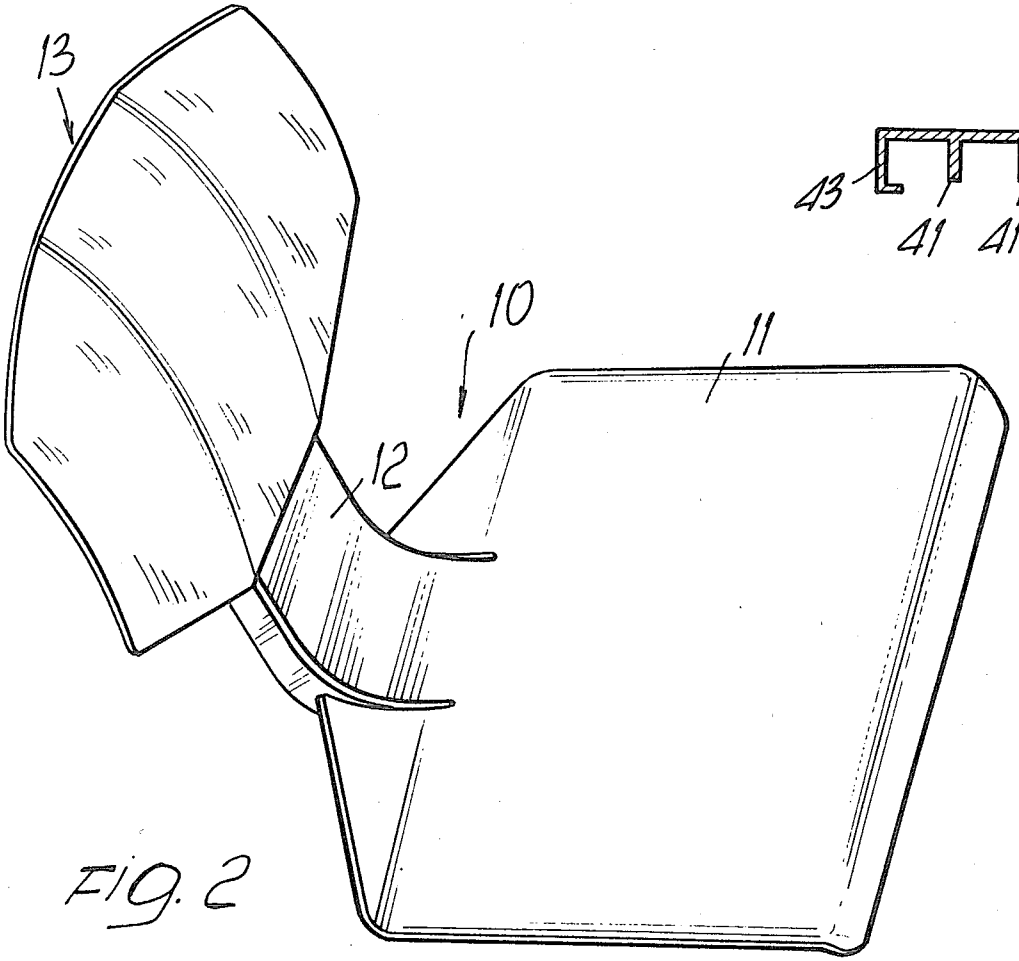
FIG. 2 is a schematic perspective view of the body of the chair.
Figure 5:
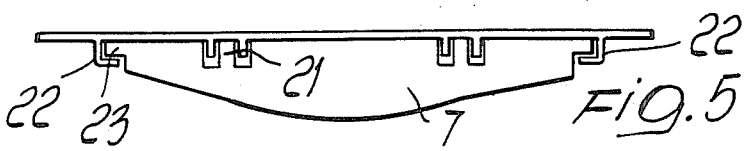
FIG. 5 is a section taken on the line V—V of FIG. 4.
Figure 4:
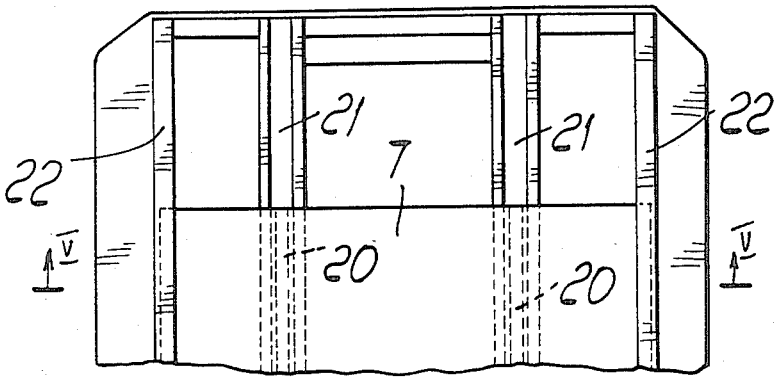
FIG. 4 is a view from below the seat of a portion of the horizontal support arm.
Figure 3:
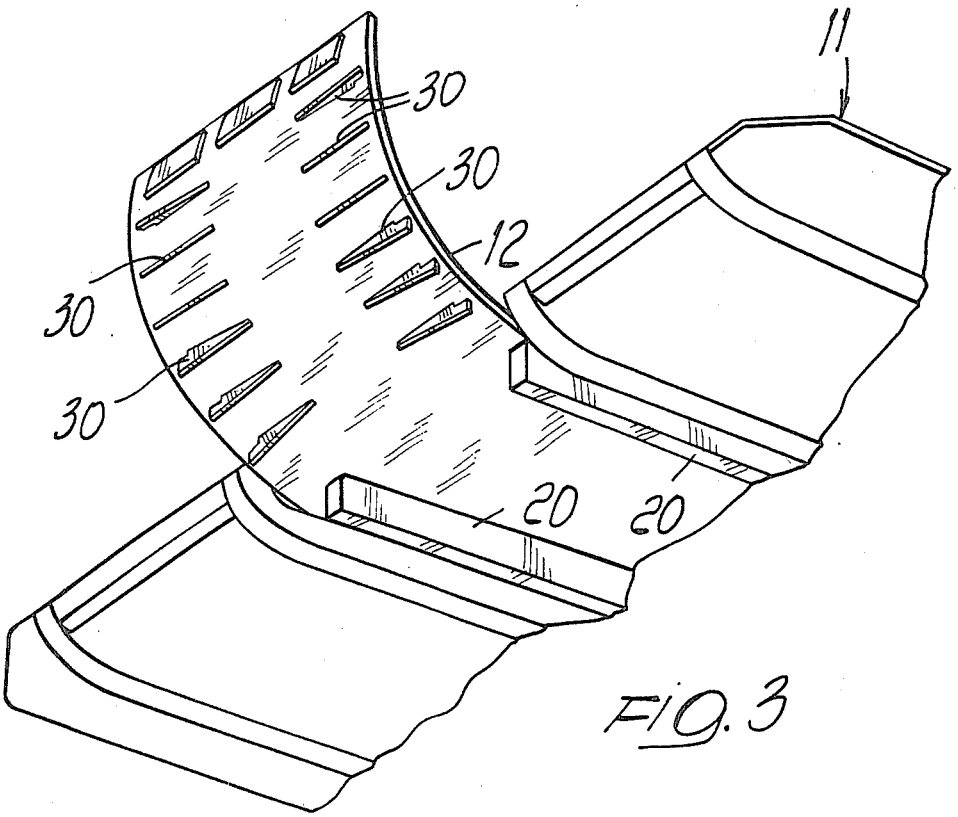
FIG. 3 is a perspective view from below of the chair with the projection for connection to the seat back clearly in view.
Figure 8:
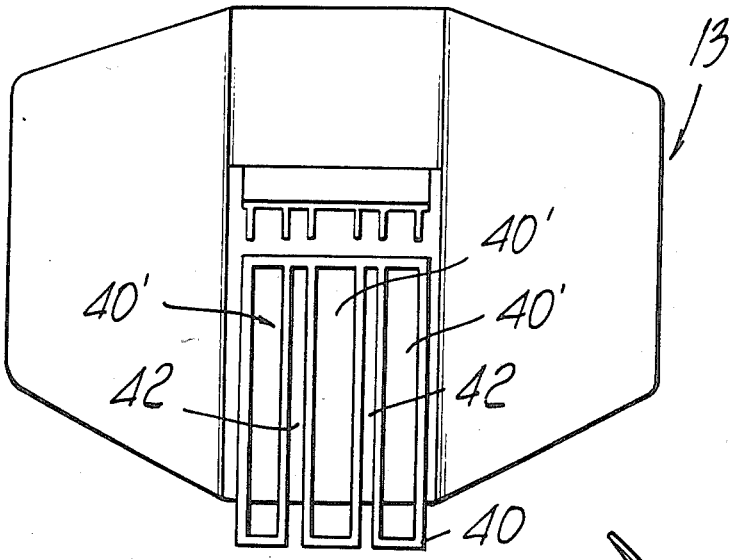
FIG. 8 is a view from the rear of the chair back, together with the sliding carriage connected to the vertical arm.

The multiple-position chair structure shown in the drawings is indicated generally with the reference numeral 1 and comprises a support frame 2 of substantially L-shape conformation which is supported by a base 3. The base 3, in this preferred embodiment has a plurality of radially extending feet 4 provided with castors 5. The feet 4 support a vertical stem 6 to which the support frame 2 is connected.

The support frame 2, which, as indicated above, has an L-shape conformation, comprises a horizontal arm 7 and an upright arm 8. The upright arm 8 may be vertical or inclined at a small angle to the vertical and is provided for the support of the seat back whilst the horizontal arm 7 provides support for the seat.

To the said support frame 2 there is connected a composite body, generally indicated with the reference numeral 10, which comprises a seat 11 which, by means of a flexible projection 12, is connected to a seat back generally indicated 13. In more detail, as can be seen in Figures from 3 to 5, the seat 11 has longitudinal ribs 20 in its underside which constitute guide and slide elements for coupling with corresponding recesses 21 formed on the said horizontal arm 7 of the support frame 2. In this way the seat 11 is slidable with respect to the horizontal arm 7 so as to be able to assume a wide range of positions which may be selected by a user.

Figure 9:
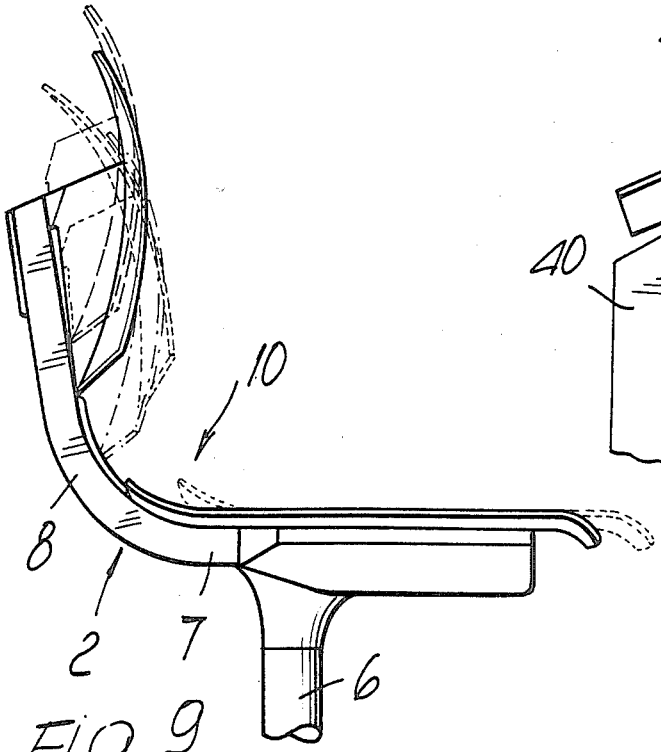
FIG. 9 is a side view of the chair showing different positions of the seat back and the seat.
Figure 10:
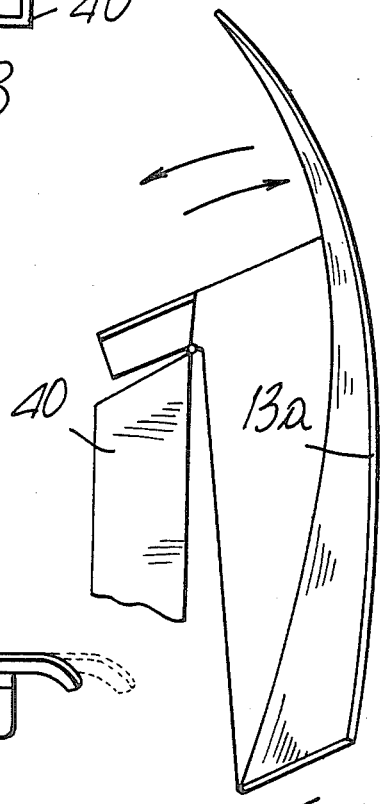
FIG. 10 is a schematic view on an enlarged scale showing the connection of the seat back to the seat back carrier.

Parallel to the ribs 20 and outwardly of these there are provided two parallel flanges 22 having an L-shape in cross section, which flanges couple with the lateral edges 23 of the horizontal arm 7 in such a way as to form an interconnection between the seat 11 and the horizontal arm 7. From the middle of the rear portion of the seat 11 there extends a flexible projection 12 which, on its rear face (that is to say on the face which is not in view during use) there are provided a plurality of spaced resilient elongated ridges 30 which allow an adjustable connection to be effected with the said seat back 13 as will be described in more detail below. More specifically, the seat back 13 has a carrier portion generally indicated 40, essentially consisting of a rectangular cross-section body in which there are defined slots 40' provided for resiliently engaging, in an adjustable way, with the resilient elongated ridges 30 of the flexible portion 12, the ridges 30 being specifically arranged and designed to be pressure fitted into said slots 40'. As is shown, the carrier portion 40 is slidably supported by the upright arm 8 by means of central longitudinal ribs 41 formed in said arm 8 which engage in longitudinal recesses 42 in the carrier 40, and two lateral flanges 43 which function as retainers. The main body of the seat back, indicated 13*a*, is pivoted to the upper corner of the carrier 40 as can be better seen in FIGS. 9 and 10, and has thus the possibility of freely turning about a substantially horizontal axis perpendicular to the plane defined by the two arms of the support frame 2, thus allowing an automatic adaptation of the inclination of the seat back in dependence on the sitting position adopted by a user.

With this coupling as described above, when sliding of the seat with respect to the horizontal arm 7 is effected, there is contemporaneously and automatically obtained a corresponding and analogous displacement of the seat back which is linked to the seat itself by means of the connection made by the flexible projection 12 which follows the conformation of the supporting frame 2 and which, in practice, serves as displacement transmission means between the seat and the seat back. In this way there is always an extremely comfortable positioning of the seat in that any forward displacement of the seat causes a corresponding lowering of the seat back, therefore allowing the utiliser to assume a more extended position, whilst if the seat is adjusted rearwardly a corresponding raising of the seat back occurs therefore assuming a more erect sitting position for the trunk of the user.

Moreover, there is no fixed rotational position of the body 13*a* of the seat back 13. It is the contact of the back of a person sitting in the chair which causes the pivoting of the seat back, and therefore the positioning of the body of the seat back is always adapted perfectly to the back of the utiliser.

The chair of the present invention can thus assume a very wide range of positions without requiring a complex adjustment mechanism. Indeed, simply by exploiting the slidable coupling between the chair body parts and the support frame therefore it is possible to provide a chair with the advantage of having the seat back and the seat mutually interconnected by means which allow the mutual positioning between the seat and the seat back to be predetermined whilst the sitting position of a user is nevertheless adjustable over a very wide range.

What is claimed is:

1. An adjustable chair structure, comprising:

a support frame carried on a base and having a substantially L-shape with a substantially horizontal arm and an upright arm, a composite seat body carried by said L-shape support frame, said composite seat body comprising a seat part and a seat back, means slidably carrying said seat part of said composite seat body on said substantially horizontal arm of said L-shape support frame, a carrier pivotally supporting said seat back and freely slidably guiding it on said upright arm of said L-shape support frame such that adjustment of the position of said seat part of said composite seat body causes a corresponding free adjustment in the position of said seat back of said composite seat body along said upright arm, said seat part of said composite seat body having longitudinal ribs on its under face slidably engaged in longitudinal recesses formed on said substantially horizontal arm of said L-shape support frame, said seat part further having a lateral flange engageable over the lateral edges of said substantially horizontal arm, and a flexible projection extending from the middle of the rear edge of said seat part of said composite seat body and provided with a plurality of coupling resilient ridges for adjustable connection with said carrier of said seat back whereby to determine the mutual positioning between said seat part and said seat back.

2. An adjustable chair according to claim 1, wherein said seat back is connected to the upper edge of said carrier by means of a pivotal connection allowing said seat back to freely turn about a substantially horizontal axis perpendicular to the plane defined by said two arms of said L-shape support frame.

3. An adjustable chair according to claim 1, wherein said upright arm of said L-shape support frame has a plurality of longitudinal ribs engaged in corresponding longitudinal recesses in said carrier for freely slidably guiding said carrier on said upright arm, said upright arm further having lateral retaining flanges at the edges thereof.

* * * * *